United States Patent [19]

Koepke

[11] 4,267,417

[45] May 12, 1981

[54] MEMBRANE KEYSWITCH

[75] Inventor: John A. Koepke, Mount Prospect, Ill.

[73] Assignee: Illinois Tool Works Inc., Chicago, Ill.

[21] Appl. No.: 157,903

[22] Filed: Jun. 9, 1980

[51] Int. Cl.[3] ..... H01H 13/02; H01H 13/70

[52] U.S. Cl. ..... 200/159 B; 200/307; 200/317

[58] Field of Search ..... 200/159 B, 317, 310, 200/311, 314, 307, 5 A

[56] References Cited

U.S. PATENT DOCUMENTS

| | | | |
|---|---|---|---|
| 3,056,005 | 9/1962 | Larson | 200/86.5 |
| 3,591,749 | 7/1971 | Comstock | 200/167 R |
| 3,617,666 | 11/1971 | Braue | 200/86.5 |
| 3,627,927 | 12/1971 | Schmitz, et al | 178/17 C |
| 3,688,066 | 8/1972 | Adelson, et al | 200/159 B |
| 3,743,797 | 7/1973 | Hoffman | 200/159 B |
| 3,745,287 | 7/1973 | Walker | 200/159 B |
| 3,862,381 | 1/1975 | Glaister, et al | 200/159 B |
| 3,862,382 | 1/1975 | Glaister, et al | 200/159 B |
| 3,911,234 | 10/1975 | Kotaka | 200/159 B |
| 3,967,084 | 6/1976 | Pounds | 200/159 B |
| 3,987,259 | 10/1976 | Larson | 200/159 B |
| 4,017,848 | 4/1977 | Tannas, Jr | 340/365 R |
| 4,042,439 | 8/1977 | Pounds | 200/5 A |
| 4,065,649 | 12/1977 | Carter et al | 200/159 B |
| 4,066,851 | 1/1978 | White et al | 200/159 B |
| 4,085,306 | 4/1978 | Dunlap | 200/159 B |
| 4,090,045 | 5/1978 | Marsh | 200/159 B |
| 4,180,711 | 12/1979 | Hirata et al | 200/159 B |
| 4,190,748 | 2/1980 | Langford | 200/159 B |
| 4,194,097 | 3/1980 | Bradam | 200/159 B |
| 4,200,777 | 4/1980 | Miller | 200/85 A |

*Primary Examiner*—Willis Little

*Attorney, Agent, or Firm*—Thomas W. Buckman; Glenn W. Bowen

[57] ABSTRACT

The present invention is directed to a flexible, thin plastic film membrane switch in which a plastic housing houses an individual switch. The switch includes a flexible membrane which has a pair of unconnected, interleaved conductive patterns which extend over two elongated arms, each of which has an aperture through the conductive pattern. A conductive terminal is passed through each of the apertures with its sides making electrical connection with the associated conductive pattern and to lock the flexible membrane in place in a chamber of the housing of the switch. The upper portion of the flexible membrane then passes over a curved rib and is reverse bent back over the top of the terminals. A spacer formed by a piece of thin, plastic film material with a rectangular aperture in it is secured to an electrically-conductive plate to provide the necessary spacing between the conductive patterns on the membrane and the conductive plate. The flexible membrane, the spacer and the conductive plate are preferably all sealed together so that they may be handled as one complete unit. Indicator lights may be inserted into a second chamber of the switch housing through apertures in the bottom of the housing. A flexible touch panel is then inserted over the upper portion of the reverse-bent flexible membrane to complete the switch.

10 Claims, 4 Drawing Figures

Fig. 1
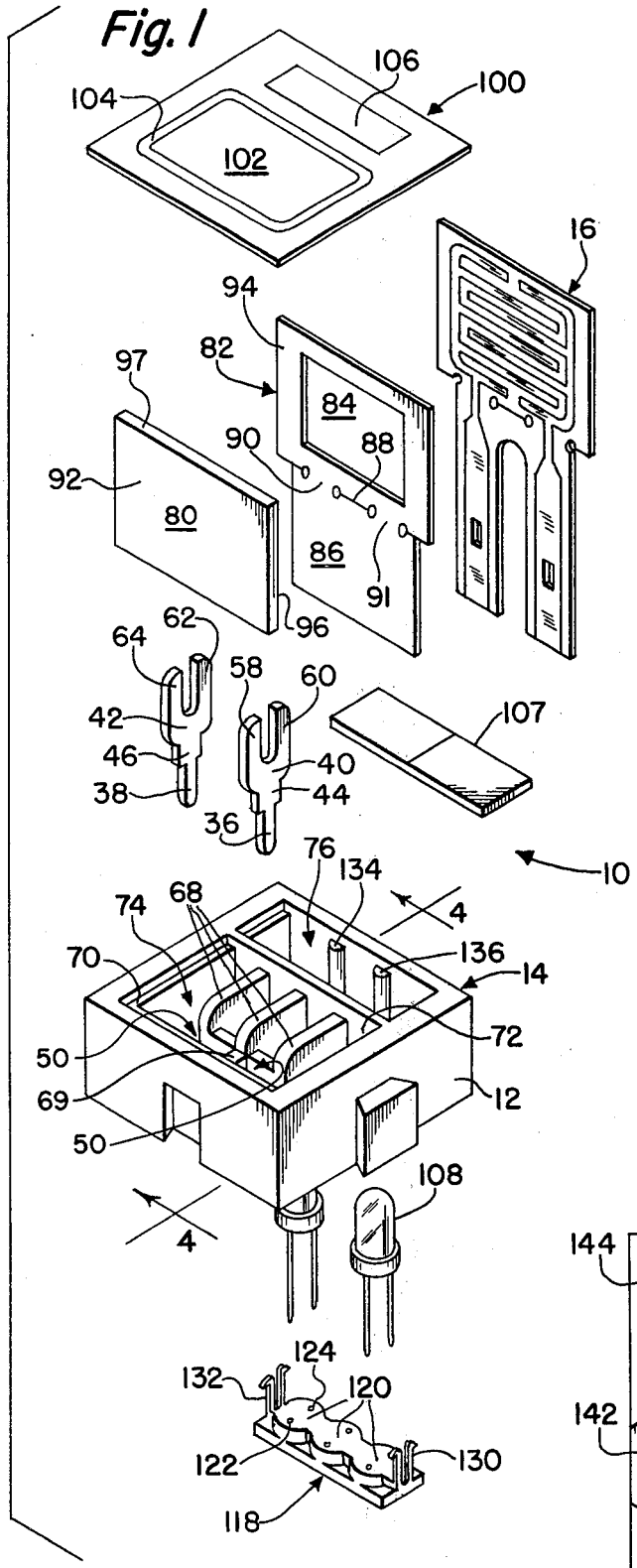
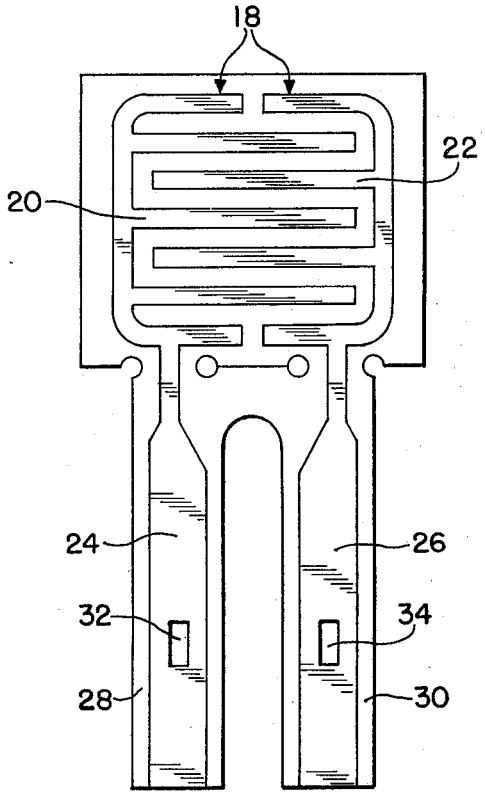
Fig. 2
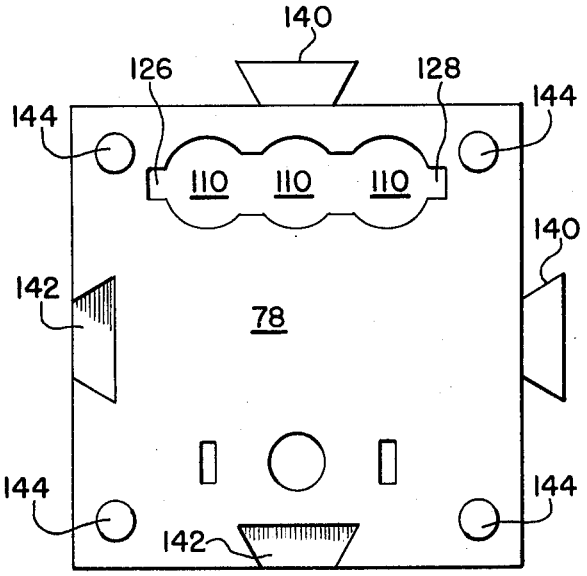
Fig. 3

MEMBRANE KEYSWITCH

BACKGROUND OF THE INVENTION

Flexible membrane switches are becoming widely used in applications such as keyboards where they are formed in large arrays. This type of switch includes a thin plastic membrane which has a flexible conductor secured to its underside by deposition, or other suitable means. A second conductor is secured to a substrate which is spaced from the first conductor carried by the flexible membrane by a spacer which is inserted on top of the substrate to leave a gap between the two conductors. Thus, when the flexible membrane is depressed, the two conductors will contact each other and the circuit will be completed.

While the flexible membrane switch array is useful for many applications, there are other applications in which it would be desirable to utilize individual membrane keyswitches, which, of course, may be arranged in an array, but which are separately removable therefrom. Such an individual switch requires a housing which can be made of a plastic, or other electrically-insulating material. In addition, the keyswitch must be constructed at a minimum of cost, and preferably without the necessity for soldering since such an operation could easily destroy the flexible membrane due to the heat developed. The membrane keyswitch of the present invention is designed to provide an individual membrane keyswitch unit with plastic housing which may be assembled without soldering in a reliable and simple manner.

DESCRIPTION OF THE DRAWINGS

The present invention is described by reference to the drawings in which:

FIG. 1 is an exploded-perspective view of the keyswitch of the present invention;

FIG. 2 is a plan view of the conductive, coated-flexible membrane of the present invention;

FIG. 3 is a bottom view of the housing of the switch of FIG. 1; and

TECHNICAL DESCRIPTION OF THE INVENTION

Figure 4:
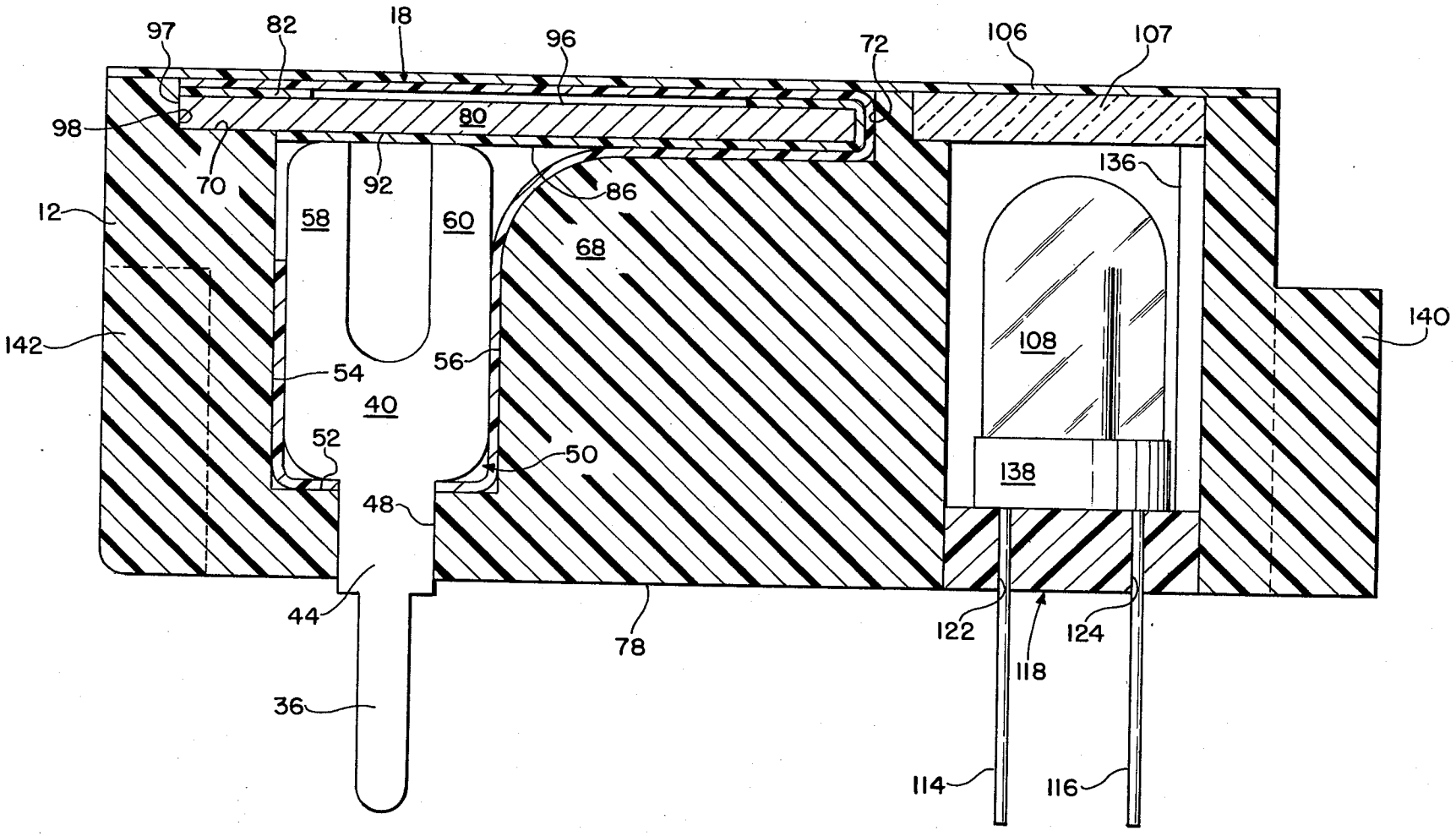
FIG. 4 is a cross-sectional view of the assembled switch of FIG. 1 taken along the lines 4—4 of FIG. 1.

Referring to the drawings, it is seen that the switch 10 is formed with a plastic housing 12 that is opened on its top 14 in order to receive the other components therein which include a flexible plastic membrane 16. The membrane 16 has a conductive pattern section 18 printed on its bottom surface which consists of two interleaved sets of conductive patterns 20 and 22 which are connected to the elongated conductor strips 24, 26 on the elongated legs 28 and 30. Rectangular apertures 32, 34 are formed in the legs 28, 30 which allow the terminal ends 36, 38 of the terminals 40, 42 to pass therethrough, as best shown in FIG. 4. The terminals 40, 42 are shown as forked members with two separate tines 58, 60 and 62, 64, although the upper portion of the terminals could be solid, or could have other configurations, if desired. The terminal ends 36, 38 pass completely through the apertures 32, 34; and directly above the terminal ends 36, 38 there are enlarged sections 44, 46 which are wedged into a passageway, such as the passageway 48 in the housing 12. The passageway 48 is just slightly smaller than the enlarged section 44 so that the contact 40 is tightly wedged into the passageway 48. A larger cavity 50 is located directly above the passageway 48. The elongated flexible legs 28, 30 of the membrane 16 are trapped against the bottom 52 of the cavity 50 and the side walls 54, 56 of the cavity 50 by the terminals, such as the terminal 40 in FIG. 4. The cavities 50 are preferably separated by the insulating wall 69.

The lower portion of the flexible membrane 16 continues past the side wall 56 and over the curved ribs 68 and then along the C-shaped ledge 70 of the front chamber 74 of the housing 12, which is best shown in FIG. 1. The membrane 16 then makes a reverse bend along the vertical wall 72 which abuts the smooth formed ribs 68 and separates the housing into the two separate chambers 74 and 76. The front chamber 74 is where the switching portion of the switch is housed and the rear chamber 76 is where the indicating lights may be inserted, as is subsequently described in more detail. The thin flexible membrane 16, after contacting the wall 72, continues across the top of the switch parallel to the bottom surface 78 of the housing 12. This parallel portion of the flexible membrane 16 is the conductive pattern section 18 where the switching action is performed.

The second contact required for switching is formed by a rectangular-shaped, thin, electrically-conductive plate, such as the plate 80, which may be a brass plate with conductive metal, such as silver or other suitable material. Spacer 82 that separates the electrode pattern 20, 22 on the membrane 16 and the conductive plate 80 is preferably formed simply by a piece of a plastic film material such as MYLAR ®, which may be shaped as shown in FIG. 1, which has adhesive on it. A window 84 appears in the upper portion of the spacer 82 and the lower portion 86 of the spacer 82 is solid, but has slightly narrower width dimensions, as shown. The spacer is slotted along the line 88 to form two hinge sections 90, 91 which allows the lower portion 86 of the spacer 82 to be secured to the rear face 92 of the conductive plate 80, while the upper window section 94 of the spacer 82 is secured to the front face 96 of the plate 80. The top edge of the plate 80 rests against the side wall 98 of the housing 12, as shown in FIG. 4. The top of the tines 58, 60 and 62, 64 of the terminals 40, 42 may engage portion 86 of the spacer 82 and may assist in supporting the conductive plate 80, if desired since portion 86 of the spacer 82 serves to insulate the terminals from the conductive plate. The terminals 40, 42 each make contact to only one of the conductive patterns 20 or 22 when the membrane is not depressed.

The flexible membrane 16, the spacer 82 and the conductive plate 80 are preferably all sealed together by adhesive on both sides of the spacer 82 so they may be handled as a complete unit.

A rectangular-shaped touch panel 100 is inserted over the assembled flat membrane keyswitch, and it has a touch area 102 which is defined by a perimeter 104. The remaining portion of the touch panel 100 is opaque except for a clear window 106 which may be used to allow illumination to pass therethrough. A diffuser plate 107 may be inserted below the window 106 if desired. Thus, when the touch panel 100 is pressed in the area 102, it will cause the membrane conductive pattern section 18 of the membrane 16 to deflect downward so that both of the conductive patterns 20 and 22 contact the conductive plate 80, which thereby completes the connection between the two sets of patterns 20, 22 and allows a closed signal condition to be transmitted between the connectors 40 and 42.

It will often be desirable to include one or more indicator lights in the described switch to provide an indication when the switch is actuated or deactuated. In the present switch, indicator lights, such as the light 108, may be inserted into the chamber 76 through the bottom 78 of the housing 12 which has three generally circular-shaped apertures 110, as shown in FIG. 3. The leads 114, 116 of the indicator lights may be secured to the same printed circuit card as terminal ends 36, 38. If desired an individual plastic retainer 118 may be employed which has a boss 120, one for each of the indicator lights, with holes 122, 124 for receiving the leads 114, 116 of each indicator light 108. The ends of the series of apertures 110 may also be formed with slots 126, 128, each of which receive one pair of deflectable locking arms 130, 132, which are provided on each end of the insert 118. When the arms are pressed together and inserted into the slots 126, 128 and are then released, they lock onto the bottom portion of the surface defined by the slots, thereby locking the insert 118 into place. A pair of semi-cylindrical posts 134, 136 are desirably provided in the chamber 76 so that they may abut against the base 138 of the indicator lights 108 so as to provide a support for the diffuser plate 107.

Another desirable feature of the switch of the present invention is that it has the capability of being locked together with a number of other switches to form an array, if desired. This is provided by the trapezoidal-shaped projecting blocks 140 and the corresponding similar-shaped recesses 142 so that a trapezoidal block 140 of one switch may be inserted into a trapezoidal recess 142 of another switch to lock the switches together in either a vertical or horizontal direction. A short cylindrical post 144 may be located at each corner of the switch to stand the switch away from a printed circuit or other substrate.

What is claimed is:

1. A membrane switch comprising an electrically insulating housing having a top and a bottom, a first chamber with at least one walled cavity therein and a plurality of passageways in communication with said cavities which extend through said bottom of said housing, a thin, flexible membrane including a plurality of elongated legs each of which have an aperture therethrough, a plurality of unconnected electrically conductive patterns on a pattern area of said membrane, each pattern of which includes an elongated conductor strip which extends over one of said legs, a plurality of electrically conductive terminals each having a terminal end which is inserted into one of said passageways so that said terminal end passes through an aperture in one of said elongated legs and projects through the bottom of said housing, the dimensions of said terminals being such that they are wedged into their associated passageways and the associated elongated leg is trapped between the walls of the associated cavity and said terminal, a conductive plate in said housing, said flexible membrane being bent so as to position said pattern area of said membrane over said conductive plate and a spacer member having a window therein which is positioned between said pattern area and said conductive plate.

2. A membrane switch as claimed in claim 1 wherein said membrane, spacer and conductive plate are all secured together as a unit prior to assembly of the switch.

3. A membrane switch as claimed in claim 1 wherein said housing has a second chamber and said bottom of said housing has at least one housing aperture therein which leads to said second chamber and said switch further comprises an overlay touch panel which is opaque except for a clear section which overlays said second chamber and at least one light means inserted into said second chamber through one of said housing apertures.

4. A membrane switch as claimed in claim 1 further comprising two trapezoidal-shaped blocks each of which extends from one side of said housing and two trapezoidal-shaped recesses, each of which is formed in two other sides of said housing.

5. A membrane switch as claimed in claim 2 wherein said housing has a second chamber and said bottom of said housing has at least one housing aperture therein which leads to said second chamber and said switch further comprises an overlay touch panel which is opaque except for a clear section which overlays said second chamber and at least one light means inserted into said second chamber through one of said housing apertures.

6. A membrane switch as claimed in claim 5 further comprising two trapezoidal-shaped blocks each of which extends from one side of said housing and two trapezoidal-shaped recesses, each of which is formed in two other sides of said housing.

7. A membrane switch comprising an electrically insulating housing having an open top and a closed bottom, a first chamber with at least one walled cavity therein and first and second passageways in communications with said cavities which extend through said bottom of said housing, said housing further having at least one curved rib which extends from said cavities toward said top of said housing, a thin, flexible membrane including first and second elongated legs each of whiich have an aperture therethrough, first and second interleaved, unconnected electrically conductive patterns on a pattern area of said membrane, each pattern of which includes an elongated conductor strip which extends over one of said legs, first and second electrically conductive terminals each having a terminal end which is inserted into a respective one of said first and second passageways so that said terminal end passes through an aperture in one of said elongated legs and projects through the bottom of said housing, the dimensions of said terminals being such that they are wedged into their associated passageways and the associated elongated leg is trapped between the walls of the associated cavity and said terminal, a conductive plate in said housing, said flexible membrane having a reverse bend therein which positions said pattern area of said membrane over said conductive plate and said terminals, and at least a portion of said membrane intermediate said pattern area and apertures in said elongated legs is positioned to engage said ribs, said conductive plate being positioned intermediate said pattern area and said terminals and a spacer member having a window therein which is positioned between said pattern area and said conductive plate.

8. A membrane switch as claimed in claim 7 wherein said membrane, spacer and conductive plate are all secured together as a unit prior to assembly of the switch.

9. A membrane switch as claimed in claim 8 wherein said housing has a second chamber and said bottom of said housing has at least one housing aperture therein which leads to said second chamber and said switch further comprises an overlay touch panel which is opaque except for a clear section which overlays said second chamber and at least one light means inserted into said second chamber through one of said housing apertures.

10. A membrane switch as claimed in claim 9 further comprising two trapezoidal-shaped blocks each of which extends from one side of said housing and two trapezoidal-shaped recesses, each of which is formed in two other sides of said housing.

* * * * *